United States Patent [19]

Makino

[11] 4,356,718

[45] Nov. 2, 1982

[54] BENDING TOOL

[76] Inventor: Osamu Makino, 1-15, Bubai-cho, Fuchu-shi, Tokyo, Japan

[21] Appl. No.: 197,733

[22] Filed: Oct. 16, 1980

[30] Foreign Application Priority Data

Oct. 25, 1979 [JP] Japan ..... 54-138376

[51] Int. Cl.[3] ..... B21D 5/01; B21D 37/10

[52] U.S. Cl. ..... 72/389; 72/413; 72/473

[58] Field of Search ..... 72/389, 386, 383, 380, 72/385, 379, 413, 412, 473, 474

[56] References Cited

U.S. PATENT DOCUMENTS

| | | | |
|---|---|---|---|
| 71,567 | 12/1867 | Barnard | 72/474 |
| 171,956 | 1/1876 | Seward | 72/474 |
| 2,792,044 | 5/1957 | Strom | 72/413 |
| 2,965,148 | 12/1960 | Oeckl | 72/413 |
| 3,495,435 | 2/1970 | Hanni | 72/448 |

FOREIGN PATENT DOCUMENTS

| | | | |
|---|---|---|---|
| 2315334 | 1/1977 | France | 72/389 |

*Primary Examiner*—Gene Crosby
*Attorney, Agent, or Firm*—Karl W. Flocks

[57] ABSTRACT

A tool for bending a sheet material into a L-like or Z-like section. A pair of bending members each having a bending edge and a rectangular cavity formed in juxtaposition are disposed movably toward and away from each other so that the bending edge of one of the bending members is movable into the cavity of the other bending member and vice versa. The cavity is of such a cross section that a major surface of the sheet material being bent is left free from the inner wall of the cavity.

6 Claims, 11 Drawing Figures

PRIOR ART

BENDING TOOL

BACKGROUND OF THE INVENTION

1. Field of the Invention

The present invention relates generally to a bending machine. In particular, the invention concerns an improvement of a bending tool for bending under pressure a blank material such as an elongated metal sheet into a section or a channellike member having a V-like, L-like, Z-like or similar cross-section.

2. Description of the Prior Art

Numerous and various types of metallic channel members of L-like, V-like or Z-like cross-section are widely used as brackets, reinforcing members and so forth for various structures machines, equipments or the like. The channel members of these cross-sections are generally manufactured by using hydraulic press bending machines such as one shown in FIG. 1 and commercially available from Promecam Company in France, or Amada Company in Japan, for example. For having a better understanding of advantageous features of the invention, a typical one of the hitherto known hydraulic press bending machine will be described in some detail.

Referring to FIG. 2 which shows in an enlarged fragmental perspective view a portion of the hydraulic press bending machine designated generally by reference letter P in FIG. 1, a bending tool comprises a male die or punch 2 mounted on a main body 1 of the bending machine P and a female die 3 having a cavity of V-like cross-section and mounted on a table 4, both dies being disposed in a vertical alignment with each other. Usually, the table 4 is moved vertically upward so that the male die or punch 2 is engaded in the V-like cavity of the female die 3, whereby a metal sheet 6 interposed between the punch 2 and the V-like female die 3 is bent into a corresponding section or channel member. Typical processes for manufacturing a L-like or Z-like channel member or section with the aid of the bending machine P are illustrated in FIGS. 3 to 5.

In the first place, reference is made to FIG. 3 which illustrates a working process of bending a flat metal bar into a L-like section. The bending tool comprises a male die or punch 2 fixedly mounted on the main body 1 of the bending machine P by means of bolts 5 or the like and a female die 3 having a cavity of V-like cross-section and mounted fixedly on the table 4 of the bending machine. The punch 2 and the female die 4 are disposed in vertical alignment and in opposition with each other. The sheet material 6 to be bent is interposed between the punch 2 and the female die 4, whereby the sheet or flat material 6 is bent into a L-like section under pressure produced by moving one of the punch 2 and the female die 3 to the other, i.e. through relative displacement of the male and female dies toward each other in the vertical direction. As can be seen from FIG. 3, the lower end portion of the male die or punch 2 is formed with a pointed bending edge having a bending angle of about 90° and a perpendicular bisector passing through the pointed edge. On the other hand, the female die 3 has the V-like cavity which is defined by inclined opposite side faces intersecting each other at about 90° and has a perpendicular bisector extending through the intersection. The V-like punch 2 and the V-like female die 3 are geometrically and positionally so aligned to each other that the pointed bending edge portion of the V-like bending punch 2 will snugly fit in the cavity of the female die 3 in a manner complementary to each other. Accordingly, when the V-like bending punch 2 is pressed down into the V-like cavity of the female die 3 with the sheet material 6 being interposed therebetween, the latter is forcively fitted into the V-like cavity of the female die 3 under the pressing and bending action of the V-like punch (i.e. male die) 2 and undergoes plastic deformation to be shaped into a L-like section. In this way, the L-like section or channel member can be fabricated.

Referring to FIG. 4 which illustrates a typical one of the conventional processes for bending a sheet metal into a Z-like section, a punch 7 having a working lower end of a corresponding sectional form is fixedly secured to the main body 1 of the bending machine P by means of bolts 5 or the like, while a die 8 having a sectional form complementary to that of the punch 7 is secured to the table 4 in a manner similar to the structure illustrated in FIG. 3. By moving one of the punch 7 and the die 8 to the other or both in opposition to each other in the vertically aligned direction, the metal sheet 6 disposed between the punch 7 and the die 8 is bent into a Z-like section. It will be seen that when the punch 7 is caused to engage in the die 8, the bending edge portion 9 of the punch 7 is complementarily and snugly fitted in a cavity or groove 10 of the die 8 while V-like edge 11 thereof is caused to engage in a groove 12 formed in the lower end face of the punch 7 in a complementary manner. Accordingly, by selecting the height of the bending edges as well as the depth of the cavities of the punch 7 and the die 8 at proper values, a metal sheet 6 having a predetermined thickness t and disposed on the die 8 can be bent into a Z-like section in conformance with the profiles of the bending members 7 and 8, whereby a Z-like section member having a predetermined bend width h can be manufactured.

The hitherto known press bending machine described above has however encountered some difficulties which will be briefly discussed below.

The first problem lies in the fact that the punch and the counterpart die are substantially unexchangeably combined in a set for manufacturing a L-like or Z-like section of a predetermined dimension or size. As the consequence, in order to manufacture the L-like or Z-like sections or channel members of different dimensions, a corresponding number of the bending tools, i.e. the sets of punches and dies have to be previously provided. Each time when the dimension or size of the section to be formed is changed, the bending tool has to be replaced by other one of the corresponding dimension. This holds true even in the case where a section to be formed differs in dimension only a little from the preceeding one. It goes without saying that preparation of a large number of the bending tools in view of numerous types of the L-like or Z-like sections or channel members involves necessarily a great expenditure and that replacement of the punches and the counterpart dies in dependence on the dimensions or sizes of the products is a time consuming and troublesome procedure. Such problem becomes more serious in the bending work for manufacturing the Z-like section. For example, the combination of the bending punch 7 and the die 8 for producing the Z-like section illustrated in FIG. 3 can be used effectively only for the product having the bend width h of a predetermined value. For producing the Z-like sections of different widths h, a corresponding number of the tools have to be previously prepared. If there is available no appropriate tool for a specific dimension of the section, a new bending tool (i.e. a new combination of punch and die) has to be first manufactured.

The second problem can be seen in the fact that when the bend width h is required to be very small as compared with the sheet thickness t, as is illustrated in FIG. 5, the bending operation can no more be effected with a satisfactory accuracy with the hitherto known tool. More specifically, when a metal sheet material 6 is to be bent into a Z-like section with the bend width h of a very small value by means of the appropriate set of the punch 7 and the die 8, a portion of the sheet 6 which extends outwardly from the portion sandwiched between the punch 7 and the die 8 tends to be bent downwardly about a point A instead of extending straight along a phantom line e, as illustrated in an enlarged scale in FIG. 5*a*. On the other hand, the portion of the sheet 6 sandwiched between the bending members is squeezed and tends to be decreased slightly in the thickness, resulting in the formation of a slight bulge in the vicinity of the point A. This phenomenon may be explained by the fact that the sheet material located immediately below the bending edge 9 of the punch 7 or located immediately above the bending edge 11 of the die 8 (see FIGS. 4 and 5) can not reach the bottom of the counterpart cavity due to the small dimension of the bend width h, whereby the material being deformed tends to be displaced outwardly, to bring about a so-called shear droop. In this way, it has been very difficult to bend a metal sheet into the Z-like section of a small dimension with an acceptable accuracy by means of the hitherto known bending tool assembly.

SUMMARY OF THE INVENTION

An object of the present invention is to eliminate the drawbacks of the conventional bending machines described above.

Another object of the invention is to provide a bending machine which is capable of bending a sheet material into sections or channel-like members of different sizes over a wide dimensional range with a single set of bending members.

A further object of the invention is to provide a bending tool for a bending machine which can bend a sheet material into a L-like or Z-like or other sections without requiring the replacement of the bending members.

Still another object of the invention is to provide a bending machine which is capable of fabricating a L- or Z-like or other section of very small dimension with a high accuracy.

In view of the above and other objects which will become more apparent as description proceeds, there is proposed according to a general aspect of the invention a bending tool which comprises a first bending member having a first bending projection formed with a bending edge of a substantially right angle and a first cavity disposed in juxtaposition with the first bending projection, and a second bending member having a second bending projection formed with a bending edge of above 90° and a second cavity provided in juxtaposition with the second bending projection, wherein the first and the second bending members are disposed in opposition to each other in such a manner that a perpendicular bisector plane passing through the bending edge of the first bending projection coincides substantially with the center line of the cavity of the second bending member.

DETAILED DESCRIPTION OF THE PREFERRED EMBODIMENTS

Now, an exemplary embodiment of the present invention will be described.

Figure 6:
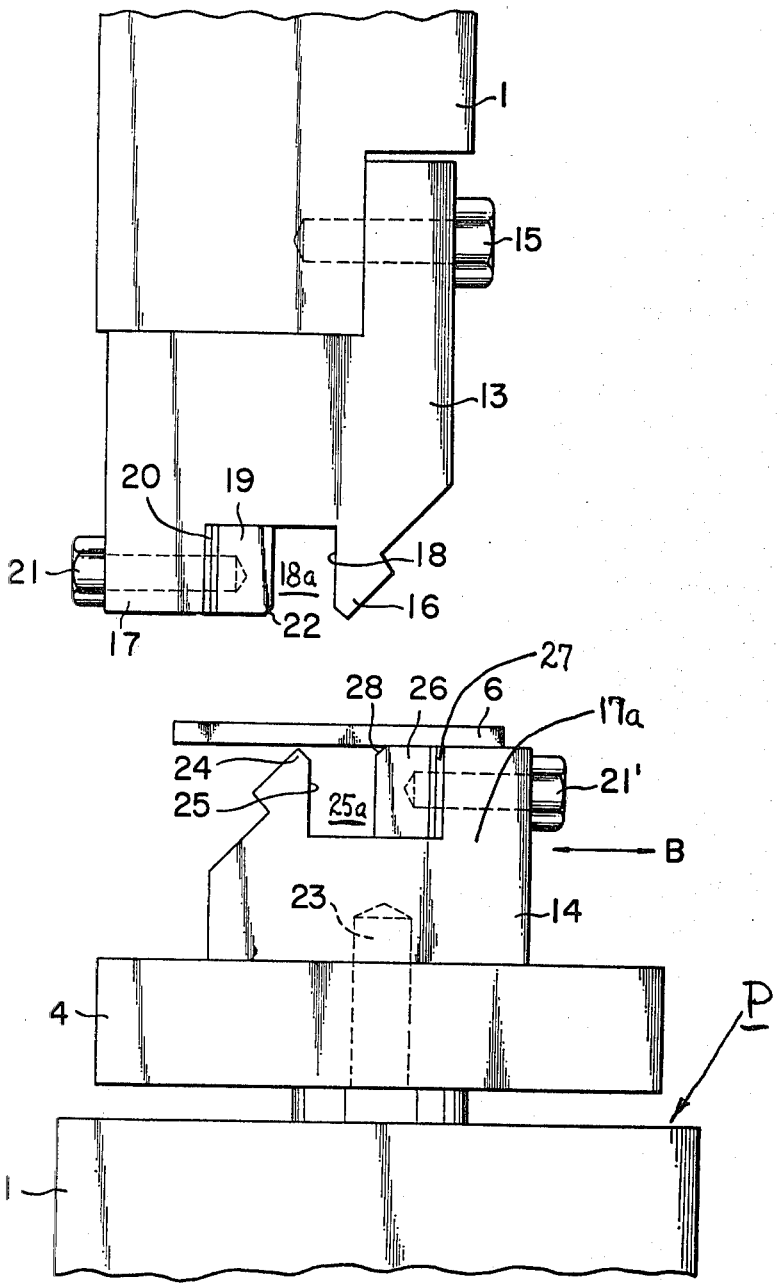
FIG. 6 is a side elevational view to illustrate schematically a bending tool according to an embodiment of the invention.

Referring to FIG. 6, a bending tool according to an embodiment of the invention comprises an upper bending member 13 and a lower bending member 14. The upper bending member 13 is fixedly secured at a base portion thereof to a main body 1 of a bending machine P by means of bolts 15 or the like clamping means. Formed integrally with the upper bending member 13 is a wedge-shaped bending projection 16 which in turn is formed with a bending edge imparted with a bending angle of about 90°. A support 17 is integrally formed with the upper bending member 13 in parallel with the bending projection 16 with a groove 18 of a substantially rectangular cross-section and having a predetermined depth being interposed between the bending projection 16 and the support 17. Disposed within the groove 18 is a die cavity definning block 19 of a substantially rectangular cross-section which is fixedly attached to the inner wall of the support 17 by means of screws 21 (only one which is shown). The block 19 serves to define a die cavity 18*a* in cooperation with the inner wall of the bending projection 16. In order to make the opening or width of the die cavity 18*a* adjustable, spacers 20 are disposed between the cavity defining block 19 and the support 17. It will thus be appreciated that the width or opening of the die cavity 18*a* can be varied over a wide range by increasing or decreasing the number of the spacers 20. In a version of the structure shown in FIG. 6, the position of the cavity defining block 19 can be adjusted to thereby vary the die opening 18*a* by means of the screw 21 itself which is secured axially immovably to the support 17. In this case, the spacer 20 may be spared. It will be seen that a corner 22 of the cavity defining block 19 is chamfered at 45° with reference to the horizontal as viewed in FIG. 6. On the other hand, the bending edge of the bending projection 16 is so positioned that the perpendicular bisector passes through the bending edge.

Disposed below the upper bending member 13 is a lower bending member 14 which is fixedly mounted on a table 4 of the bending machine P by means of screws 23 (only one of which is shown in FIG. 6). By loosening the screws 23, the lower bending member 14 can be displaced in the directions indicated by a double-head arrow B in FIG. 6, whereby the lower bending member 14 can be positioned adjustably relative to the upper bending member 13. There are formed at the top side of the lower bending member 14 a bending projection 24 formed with a bending edge having a bending angle of about 90° and a groove 25 of a substantially rectangular section in which a die cavity defining block 26 is disposed and secured to a support 17*a* by means of screws 21 or the like clamp means with adjusting spacers 27 being interposed between the block 26 and the support 17*a* in a substantially same manner as the upper bending member 13. The block 26 defines a die cavity 25*a* in cooperation with an inner vertical wall of the bending projection 24. A corner 28 of the cavity defining block 26 is chamfered at 45° relative to the horizontal in a width of the order of several millimeters as is in the case of the cavity defining block 19 of the upper bending member 13. The bending edge of the bending projection 24 is so positioned that the perpendicular bisector passes through the apex or tip of the bending edge. It should further be mentioned that the lower surface of the cavity defining block 19 is positioned substantially flush with the bending edge of the bending projection 16 of the upper bending member 13, while the top surface of the cavity defining block 19 is at a substantially same height as the bending edge of the bending projection 24 of the lower bending member 14. Further, it should be noted that the grooves 18 and 25 are of such a depth that the bending edges of the bending projections 16 and 24 will not bear against the bottoms of the grooves 25 and 18, respectively, when the upper bending member 13 is engaged with the lower bending member 14 in the bending operation.

For positioning the upper and the lower bending members 13 and 14, it is required that a vertical plane extending through the apex of the bending edge of the bending projection 16 will pass through the center line between the tip of the bending edge of the bending projection 24 and the chamfered corner 28 of the cavity defining block 26. Such positioning can be easily attained by correspondingly adjusting the position of the lower bending member 14 in the manner described hereinbefore. In this connection, it can be seen that since the upper and the lower bending members 13 and 14 are in an inverse symmetric configuration relative to each other, the centering of the lower bending member 14 only relative to the upper bending member 13 or vice versa is sufficient for attaining the desired positional alignment between both the bending members 13 and 14.

Figure 7:
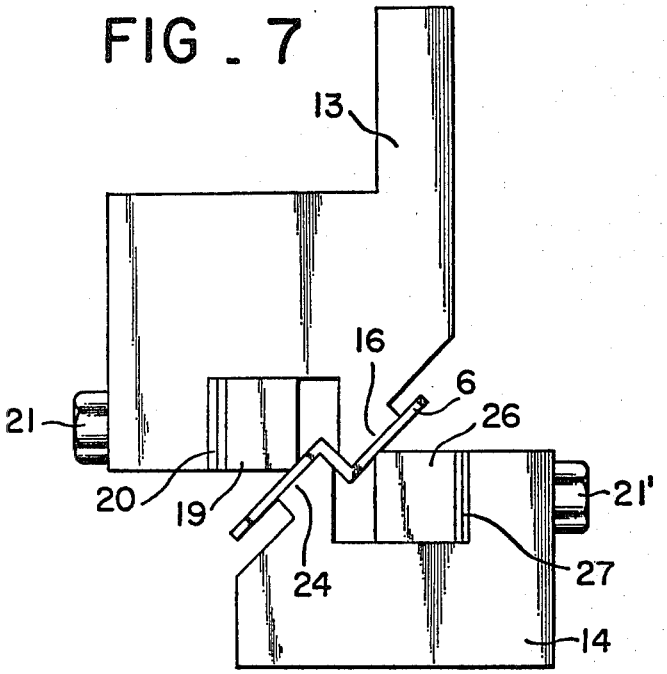
FIG. 7 illustrates a process of bending a metal sheet into a Z-like section with the aid of the bending tool according to an embodiment of the invention.

In bending operation, a metal sheet 6 to be bent is disposed on the lower bending member 14. Subsequently, the upper bending member 13 is pressed downwardly, as the result of which the tip of the bending edge of the upper bending member 13 is brought into contact with the metal sheet 6 under pressure, to thereby bend the latter at a right angle and presses it downward into the die cavity 25*a* defined between the inner wall of the bending projection 25 and the block 26 of the lower bending member 14. The bending action is stopped when the metal sheet 6 being bent bears snugly against the chamfered corner 28 of the block 26 and the inner slanted surface of the bending edge of the projection 24 of the lower bending member 14. In the meantime, the bending edge of the lower bending member 14 will press the metal sheet 6 upward into the die cavity 18*a* of the upper bending member 13 until the sheet 6 is bent at a right angle and bears on the chamfered corner 22 of the block 19 and the inner slanted face of the bending edge of the upper bending member 13. In this manner, a Z-like section is formed, as is illustrated in FIG. 7.

Figure 1:
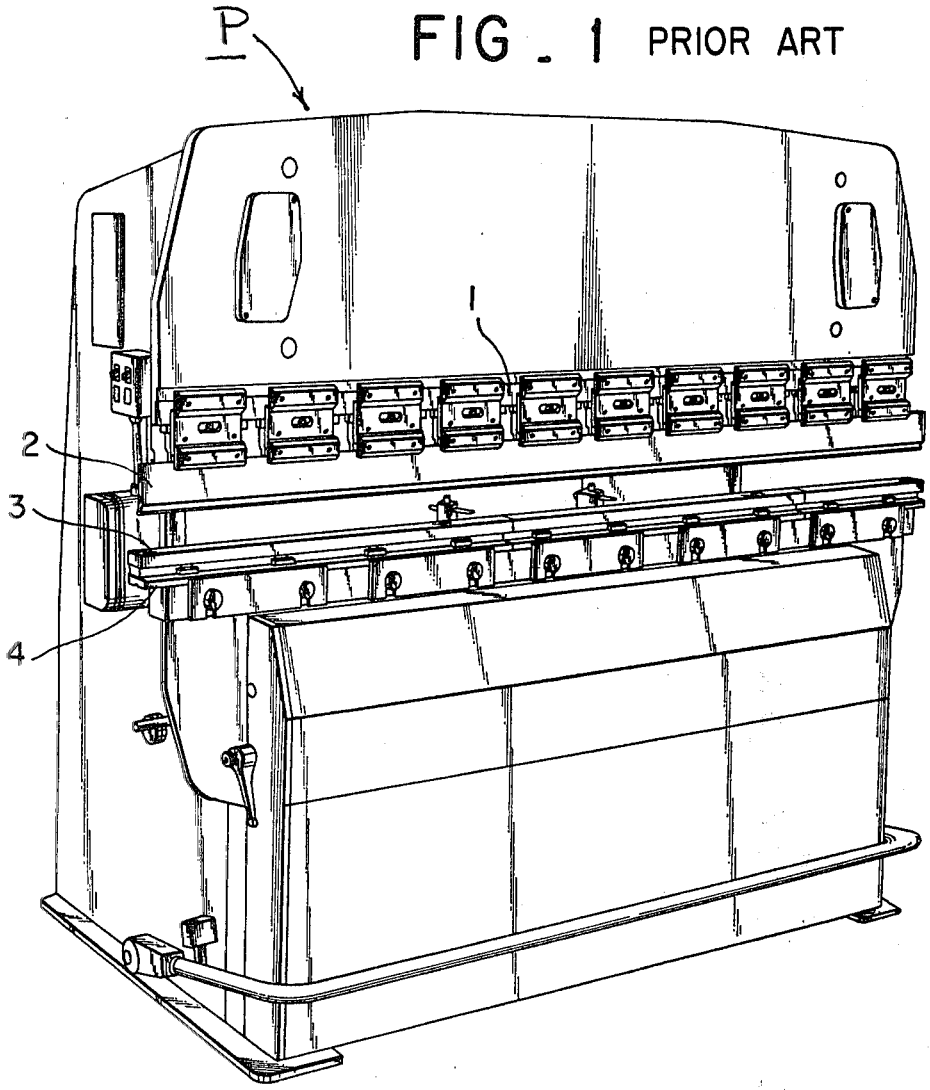
FIG. 1 PRIOR ART
FIG. 1 shows pictorially a bending machine to which the invention can be applied.
Figure 2:
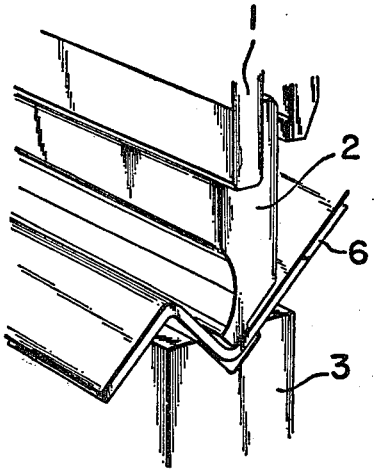
FIG. 2 PRIOR ART
FIG. 2 shows in an enlarged fragmental view a hitherto known bending tool used in the bending machine shown in FIG. 1.
Figure 3:
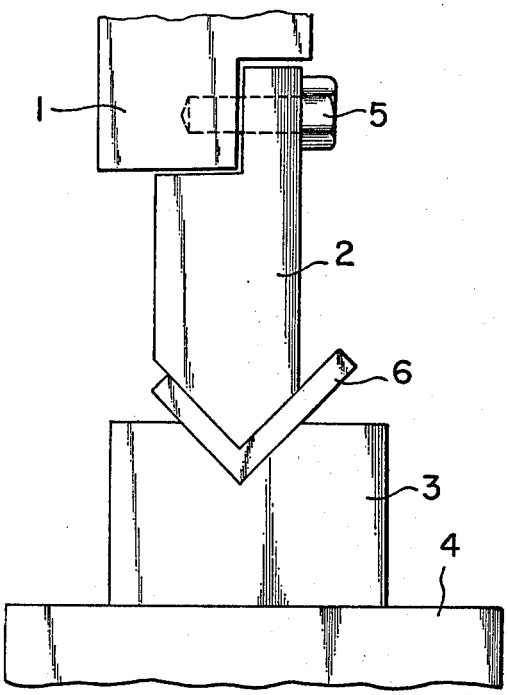
FIG. 3 PRIOR ART
FIG. 3 is a side elevational view illustrating schematically a bending tool used heretofore for fabricating a L-like section member.
Figure 4:
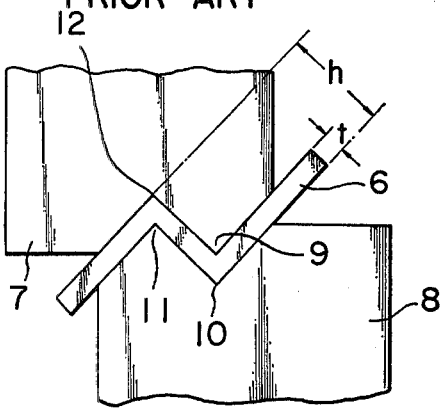
FIG. 4 PRIOR ART
FIG. 4 is a fragmental side view illustrating schematically a bending tool used heretofore for fabricating a Z-like section member.
Figure 5:
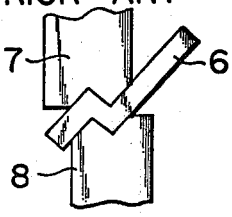
FIG. 5 PRIOR ART
FIG. 5 is a view similar to FIG. 4 and shows a bending tool for use in fabricating a Z-like section member of a small size.
Figure 5A:
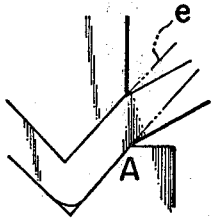
FIG. 5*a* is an enlarged fragmental view of FIG. 5 and illustrates operation and action of the bending tool.
Figure 8:
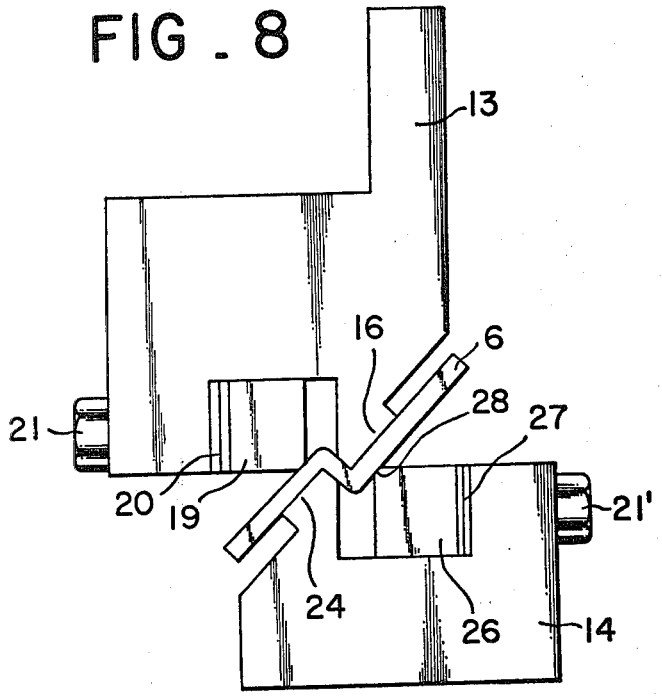
FIG. 8 is a view similar to FIG. 7 to illustrate a bending operation for forming a section member of a different size.

When a Z-like section of a different bend width h (refer to FIG. 4) is to be formed, the die openings 18*a* and 25*a* defined between the bending edges and the blocks 19 and 26 of the upper and the lower bending members 13 and 14, respectively, are correspondingly varied by increasing or decreasing the number of the spacers, which is accompanied by the corresponding adjustment of the position of the lower bending member 14. The bending operation may then be carried out in the manner described above, whereby a Z-like section of a different bend width h can be formed. Reference is to be made to FIG. 8. It should be mentioned that the bending can be effected with a high accuracy even when the thickness t of the metal sheet is relatively great, because the major portion of the sheet material 6 is not closely and tightly confined within the die cavities but remains free except for those portions which are sandwiched between the side surface of the bending edge and the chamfered corner, as can be seen from FIGS. 6, 7 and 8. Consequently, the sheet material does not undergo squeezing pressure within the tightly enclosed cavity, involving no shear droop as described hereinbefore in conjunction with the prior art bending tool.

Figure 9:
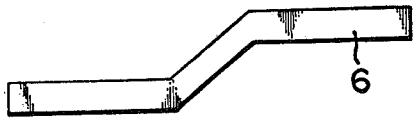
FIG. 9 is an end view of a section member which can be manufactured by means of the bending tool according to the invention.

When the bending operation is stopped on the way, a Z-like section of an inclined bend shown in FIG. 9 can be manufactured.

Figure 10:
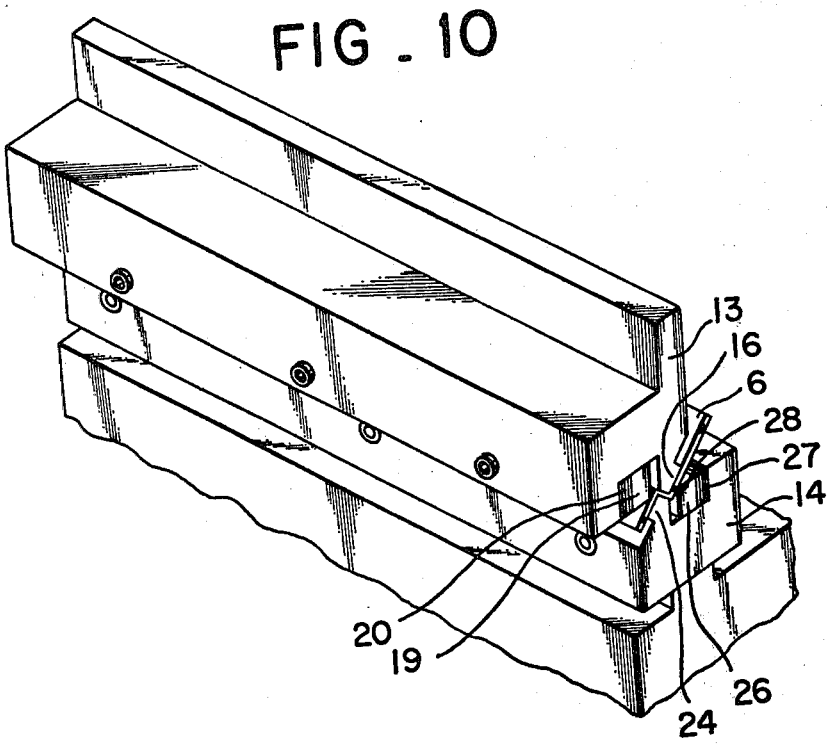
FIG. 10 is a perspective view illustrating a state in which a bending tool according to the invention is used for a bending operation.

FIG. 10 shows in a perspective view of a bending tool according to the invention. As can be seen from this figure, an elongated metal sheet or bar 6 can be bent into a desired section along the longitudinal axis thereof by using the upper and the lower bending members 13 and 14 of a corresponding length. The upper bending member 13 is supported at the flanges between the supports of the bending machine, while the lower bending member 14 is mounted on the table 4 which is adapted to be moved upwardly so that the upper and the lower bending members 13 and 14 mesh with each other for effecting the bending operation of the sheet 6.

As will be appreciated from the foregoing description, the bending tool according to the invention can be used to manufacture the L-like or Z-like sections of different sizes over a wide dimensional range without necessity for replacing the working elements, by virture of such arrangement that each of the oppositely disposed bending members is provided with the die cavity of adjustable die opening in juxtaposition with the bending edge. There is no necessity for preparing a number of the bending tools for the products of different dimensions. Thus, the invention is very advantageous from the economical viewpoint. Further, the bending tool according to the invention allows sections of various dimensions to be realized very inexpensively with an enhanced accuracy.

I claim:

1. A bending tool for bending a sheet material into a section, comprising a first bending member having a first bending projection formed with a bending edge of a substantially right angle and a first groove having a predetermined depth and an adjustable width and disposed in juxtaposition with said first bending projection, and a second bending member having a second bending projection formed with a bending edge of a substantially right angle and a second groove having a predetermined depth and an adjustable width and disposed in juxtaposition with said second bending projection, wherein said first and second bending members are disposed to be movable in opposition to each other in such a manner that a perpendicular bisector extending through the apex of the bending edge of said first bending projection passes substantially a center of said second groove, while a perpendicular bisector extending through the apex of the bending edge of said second bending projection passes substantially a center of said first groove.

2. A bending tool as set forth in claim 1, wherein a block is disposed in each of said first and second grooves at a side remote from said bending edge, whereby the width of each of said grooves is adjustable by varying position of said block.

3. A bending tool as set forth in claim 2, wherein said block is mounted on each of said first and second bending members by means of lead screws so that the position of said block can be adjusted by rotating said lead screws.

4. A bending tool as set forth in claim 2, wherein said block is mounted on each of said first and second bending members with spacers being interposed therebetween, whereby the position of said block can be varied by means of said spacers.

5. A bending tool as set forth in claim 2, wherein said groove and said block are of a substantially rectangular cross-section, and a corner of said block located adjacent to said bending edge is chamfered with an angle of about 45°.

6. A bending tool as set forth in claim 1, wherein the depth of said groove is so selected that said bending edge of one member reaches short of the bottom of said groove of the other member when said first and second bending members are meshed with each other.

* * * * *